US006848459B2

(12) United States Patent
Ma

(10) Patent No.: US 6,848,459 B2
(45) Date of Patent: Feb. 1, 2005

(54) UMBRELLA CANOPY ORIENTATING DEVICE

(76) Inventor: Joen-Shen Ma, 12F, No. 578, Kwang Fu South Road, Taipei (TW)

( * ) Notice: Subject to any disclaimer, the term of this patent is extended or adjusted under 35 U.S.C. 154(b) by 40 days.

(21) Appl. No.: 10/464,471

(22) Filed: Jun. 19, 2003

(65) Prior Publication Data

US 2004/0255993 A1 Dec. 23, 2004

(51) Int. Cl.[7] ..... A45B 17/00

(52) U.S. Cl. ..... 135/20.1; 135/98; 248/514; 403/91; 403/113; 403/161

(58) Field of Search ..... 135/20.1, 98, 74; 248/514; 403/91, 103, 104, 113, 161, 117

(56) References Cited

U.S. PATENT DOCUMENTS 3,419,295 A * 12/1968 Small ..... 403/92
4,877,045 A * 10/1989 Lin ..... 135/20.3
5,277,427 A * 1/1994 Bryan et al. ..... 473/232
5,711,331 A * 1/1998 Harris ..... 135/16
6,364,562 B1 * 4/2002 Tung ..... 403/93
6,761,180 B1 * 7/2004 Lai ..... 135/20.3
2003/0062073 A1 * 4/2003 Tung ..... 135/20.1

* cited by examiner

*Primary Examiner*—Robert Canfield
(74) *Attorney, Agent, or Firm*—Rosenberg, Klein & Lee

(57) ABSTRACT

An umbrella canopy orientating drive is applied to a large-sized umbrella. The umbrella has a central rod comprised of an upper section to which a canopy is attached and a lower section positionable on a fixed surface. The umbrella canopy orientating device includes a diverging portion having a skirt-like opening to receive the lower section of the central rod; a tube portion receiving the lower end of the upper section of the central rod; a pair of pin holes formed on the diverging portion; a pin hole formed through the upper end of the lower section; and a pin inserted through the pin holes of the diverging portion and the pin hole of the lower section to pivot the diverging portion and lower section, whereby the upper section and thus the canopy are allowed to rotate about the pivot pin with respect to the lower section between a neutral position and an inclined position to orientate the canopy in an inclined direction with respect to the lower section.

4 Claims, 4 Drawing Sheets

UMBRELLA CANOPY ORIENTATING DEVICE

BACKGROUND OF THE INVENTION

1. Field of the Invention

The present invention generally relates to a large-sized umbrella, and in particular to an umbrella having a canopy that is capable to be oriented in inclined directions.

2. The Related Art

Large-sized umbrellas are widely used in a variety of applications, such as beach umbrellas and garden umbrellas, for shading intense sunlight. Thus, some of the large-sized umbrellas are provided with a mechanism for orienting the canopy in order to adapt to the direction of sunlight. Such a mechanism is often mounted on a central rod of the umbrella. The most commonly seen mechanism for orienting the canopy is a pivotal joint formed between upper and lower sections of the central rod that allows for rotation of the upper section on which the canopy is mounted with respect to the lower section that is secured on ground. A latch is arranged between the upper and lower sections to engage holes defined in the central rod in order to selectively fix the upper section at a desired position with respect to the lower section. Such an orientating mechanism has a complicated structure and thus difficult to operate. In addition, the complicated structure raises the manufacturing costs of the umbrella.

Another conventional orientating mechanism for large-sized umbrellas includes a rope that drives the upper section with respect to the lower section and selectively fixes the upper section at different positions with respect to the lower section. A reel and associated winding mechanism are required for operating the rope. Again, the structure of the conventional orientating mechanism is complicated and costly. Maintenance and manufacturing are difficult too.

A further orientating mechanism for large-sized umbrellas is disclosed in U.S. patent application Ser. No. 10/304,677. This patent application provides an orienting mechanism which has a central rod made of metal. The central rod includes an upper section and a lower section. An enlarged opening is arranged at lower end of the upper section of the central rod. The lower section of the central rod can be inserted into the upper section through the enlarged opening. The lower section is pivoted with the upper section, so that a user can orientate the canopy in inclined directions. The enlarged opening can be used for metal central rod. If the central rod is made of wood, it is very difficult to provide the enlarged opening.

Thus, it desired to have a canopy orientating device for a large-sized umbrella that overcomes the above problems.

SUMMARY OF THE INVENTION

An object of the present invention is to provide a canopy orientating device for large-sized umbrellas having a simple structure and thus easy to operate.

Another object of the present invention is to provide a canopy orientating device for large-sized umbrellas having low manufacturing and maintenance costs.

To achieve the above objects, in accordance with the present invention, there is provided a canopy orientating device for an umbrella comprising a center rod comprised of upper and lower sections. A canopy is attached to an upper end of the upper section. A lower end of the lower section is mounted to a base positionable on a fixed surface for supporting the central rod in an upright manner. A orientating device is made of wood. The orientating device comprises a diverging portion which has a skirt-like opening to receive the lower section of the central rod and a tube portion to receive the lower end of the upper section of the central rod. A pivot pin is engaged with the diverging portion and the lower section whereby the upper section and thus the canopy are allowed to rotate about the pivot pin with respect to the lower section between a neutral position and an inclined position to orientate the canopy in an inclined direction with respect to the lower section.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 1:
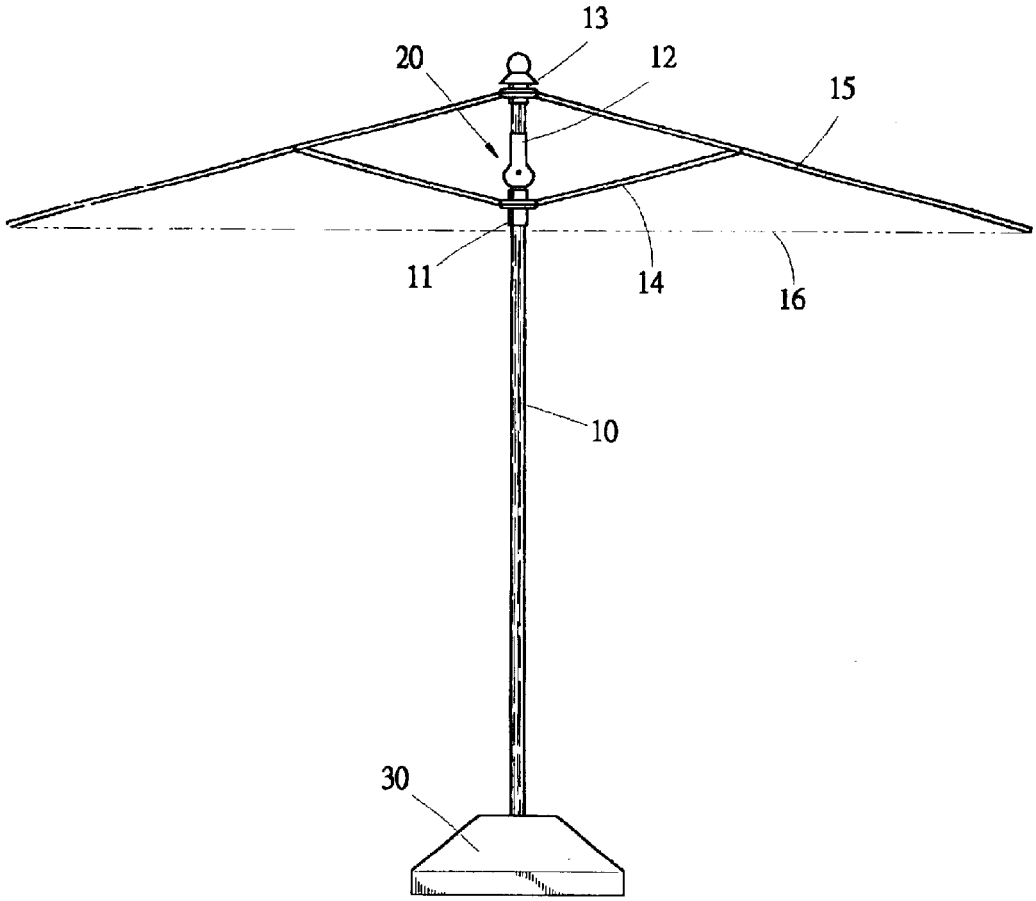
FIG. 1 is a side elevational view of a large-sized umbrella in which a canopy orientating device constructed in accordance with the present invention is embodied.
Figure 2:
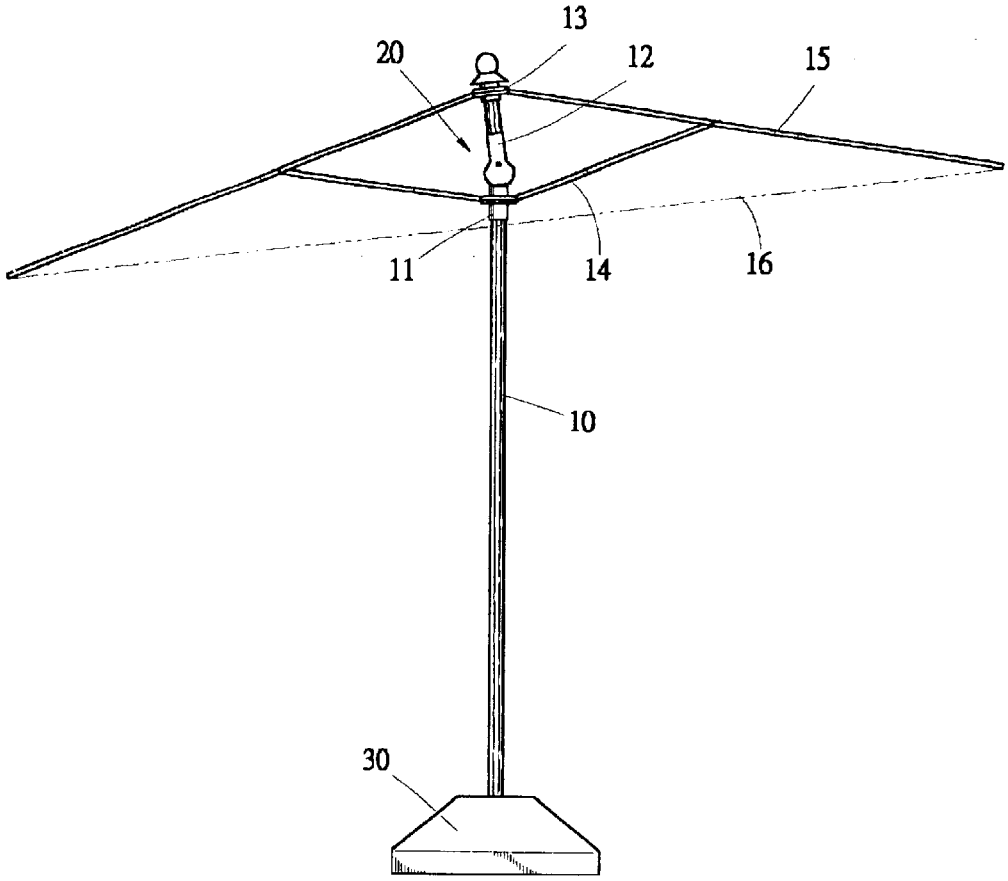
FIG. 2 is similar to FIG. 1 but showing a canopy of the umbrella is orientated in an inclined direction.
Figure 3:
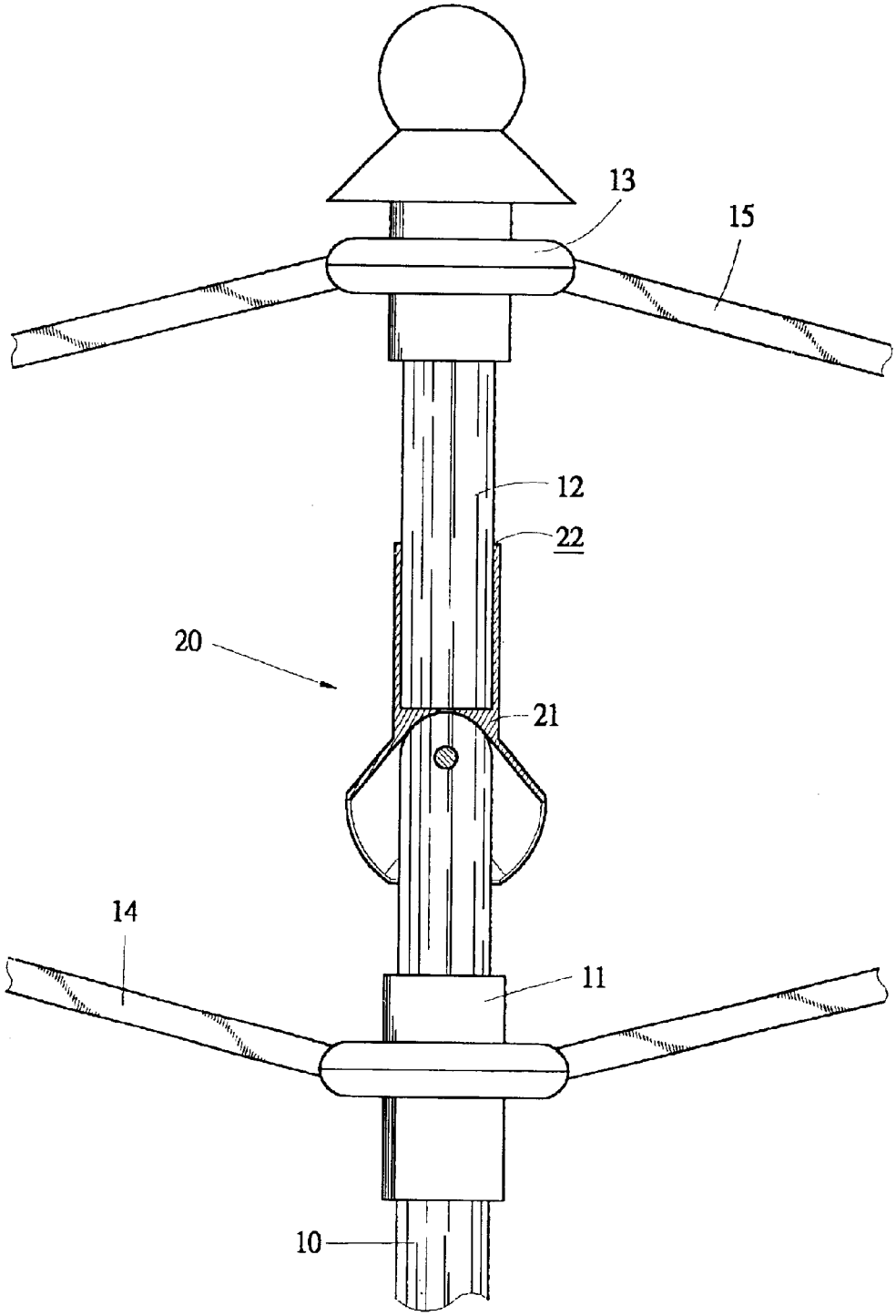
FIG. 3 is a cross-sectional view of a canopy orientating device constructed in accordance with the present invention in a neutral position.

With reference to the drawings and in particular to FIGS. 1, 2 and 3, an umbrella having a canopy orientating device 20 of the present invention is embodied is shown. The canopy orientating device 20 is applied to a large-sized umbrella. The umbrella comprises a central rod arranged on an upright manner. The central rod comprises a lower section 10 and an upper section 12. The lower section 10 has a lower end mounted to a base 30 positioned on a fixed surface. The upper section 12 has an upper end to which a crown 13 is attached. A runner 11 is movably fit over and slidable along the lower section 10 of the central rod. A plurality of ribs 15 is pivotally attached to the crown 13 and radially extends from the crown 13 for supporting a canopy 16. A stretcher 14 has opposite ends respectively pivoted to the runner 11 and each rib 15. Moving the runner 11 toward the crown 13 drives the stretchers 14 to expand the ribs 15, thus opening the umbrella canopy 16, and moving the runner 11 away from the crown 13 allows the ribs 15 to collapse and thus closing the umbrella canopy 16.

Figure 4:
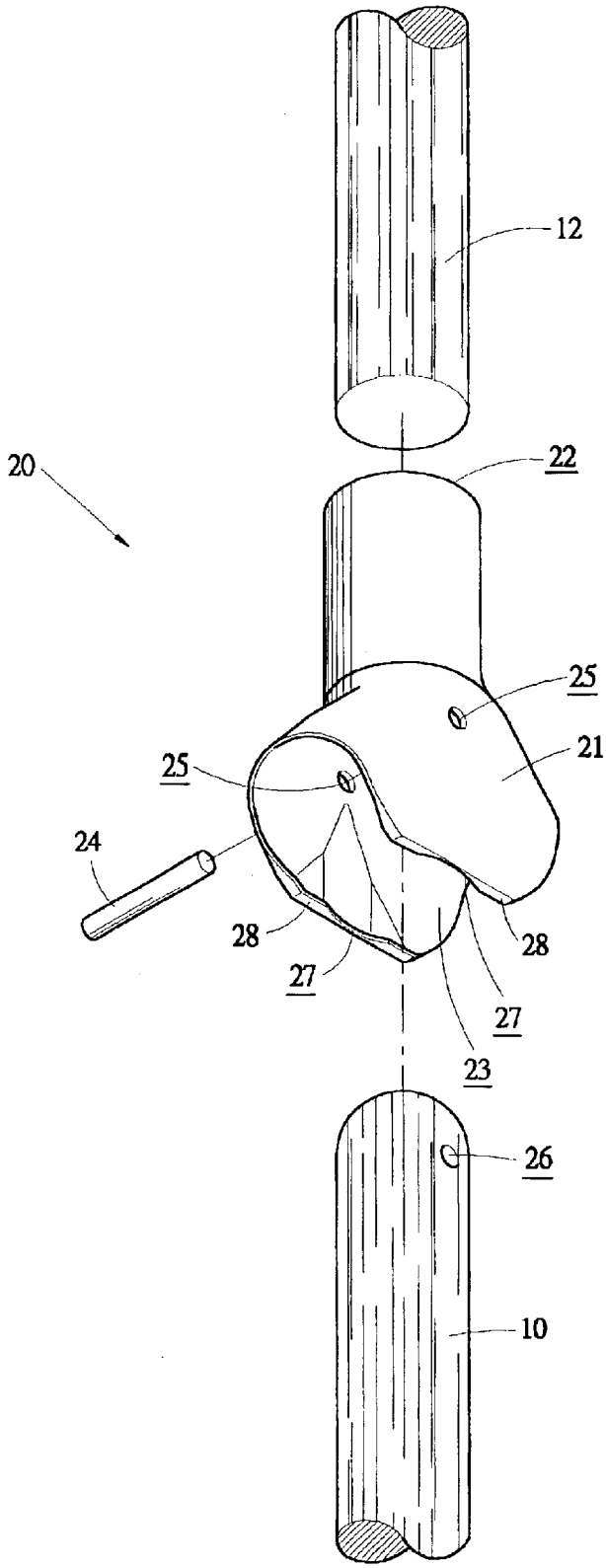
FIG. 4 is an exploded view of the canopy orientating device in accordance with the present invention.

Also referring to FIGS. 2–4, the canopy orientating device 20 of the present invention is arranged between upper end of the lower section 10 and the lower end of the upper section 12 for moving the upper section 12 with respect to the lower section 10 between a neutral position, as shown in FIGS. 1 and 3, and an inclined position, as shown in FIG. 2, thereby orienting the canopy 16 in inclined directions.

The orientating device 20 is made of wood. The orientating device 20 comprises a diverging portion 21 which has a skirt-like opening 23 to receive the lower section 10 of the central rod and a tube portion 22 which receives the lower end of the upper section 12 of the central rod. A pair of pin holes 25 are formed on the diverging portion 21 and a pin hole 26 is formed through the upper end of the lower section 10. The lower section 10 is inserted into the diverging portion 21 of the orientating device 20. A pin 24 is inserted through the pin holes 25 and 26, so that the lower section 10 is pivoted with the diverging portion 21. The upper section 12 is allowed to rotate about the pivot pin 24 with respect to the lower section 10. That is, the canopy 16 mounted on the upper portion 12 of the central rod can be oriented in inclined directions.

As shown in FIG. 4, a round recess 27 is formed on the inner side of the diverging portion 21. A plurality of flanges 28 is formed at both side of the rounded recess 27. The round recess 27 and the flanges 28 provide firm engagement of the upper section 12 and the diverging portion 21.

When the central rod of an umbrella is made of wood, the upper section 12 can not provide a skirt-like portion similar to the diverging portion 21 of the present invention. The orientating device 20 of the present invention is made of wood and used for wooden central rod of the umbrella.

When the umbrella is initially opened, without being acted upon by an external force, the canopy 16 that is often made of flexible materials gives a tension that maintains the upper section 12 in a neutral position with respect to the lower section 10 wherein the upper section 12 is substantially aligned with the lower section 10, as shown in FIG. 1. To change the direction of the canopy 16, manually rotating the upper section 12 with respect to the lower section 10 about the pivot pin 24, the upper section 12 and thus the canopy 16 are moved with respect to the lower section 10.

By rotating the lower section 10 about a central axis thereof with respect to the base 30 or by simply rotating the base 30, the canopy 16 that is inclined with respect to the lower section 10 can be brought to any desired direction to adapt to the direction of sunlight.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An umbrella canopy orientating drive applied to a large-sized umbrella, the umbrella having a central rod comprised of an upper section to which a canopy is attached and a lower section positionable on a fixed surface, the umbrella canopy orientating device comprising:

a diverging portion having a skirt-like opening to receive the lower section of the central rod;

a tube portion receiving the lower end of the upper section of the central rod;

a pair of pin holes formed on the diverging portion;

a pin hole formed through the upper end of the lower section; and a pin inserted through the pin holes of the diverging portion and the pin hole of the lower section to pivot the diverging portion and lower section.

2. The umbrella canopy orientating drive as claimed in claim 1, wherein the umbrella canopy orientating drive is made of wood.

3. The umbrella canopy orientating drive as claimed in claim 1, wherein the diverging portion has a round recess on the inner side of the diverging portion.

4. The umbrella canopy orientating drive as claimed in claim 3, wherein a plurality of flanges are formed at both sides of the round recess.

* * * * *